US006241179B1

(12) United States Patent
Hachiya et al.

(10) Patent No.: US 6,241,179 B1
(45) Date of Patent: Jun. 5, 2001

(54) METHOD AND APPARATUS FOR WEB FLUTTER CONTAINMENT, AND APPLICATION TO WEB SPLICING

(75) Inventors: Tadashi Hachiya; Yukio Ogawa; Katsumi Aoki, all of Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/283,290

(22) Filed: Apr. 1, 1999

(30) Foreign Application Priority Data

May 18, 1998 (JP) ..... 10-135002

(51) Int. Cl.[7] ..... B65H 19/18

(52) U.S. Cl. ..... 242/555.3; 242/555.5; 242/555.6; 242/615.11; 242/908

(58) Field of Search ..... 242/555.3, 555.5, 242/555.6, 566, 908, 615.11

(56) References Cited

U.S. PATENT DOCUMENTS

| | | | | |
|---|---|---|---|---|
| 4,308,984 | * | 1/1982 | Vits | 242/615.11 X |
| 4,936,942 | | 6/1990 | Sollinger et al. | 156/504 |
| 5,395,029 | * | 3/1995 | Kurie | 242/615.11 |

FOREIGN PATENT DOCUMENTS

| | | |
|---|---|---|
| 29 11 685 | 6/1980 | (DE) . |
| 38 15 277 | 1/1989 | (DE) . |
| 43 34 468 | 4/1995 | (DE) . |
| 0 461 812 | 12/1991 | (EP) . |
| 0 732 287 | 9/1996 | (EP) . |
| 0 744 366 | 11/1996 | (EP) . |
| 2 438 612 | 5/1980 | (FR) . |
| 58-83346 | 6/1983 | (JP) . |
| 2503149 | 4/1996 | (JP) . |
| 2552595 | 8/1996 | (JP) . |
| 9803418 | 1/1998 | (WO) . |

* cited by examiner

*Primary Examiner*—John Q. Nguyen
(74) *Attorney, Agent, or Firm*—Arent Fox Kintner Plotkin & Kahn, PLLC

(57) ABSTRACT

A wall is provided on one side of a web of paper or the like traveling along a predefined path, and an airstream is produced between the wall and the traveling web approximately in the direction of web travel. A transverse static pressure gradient is established across the airstream, causing the stream to flow close to the wall surface. This phenomenon is called as the Coanda effect. A partial vacuum created in the airstream causes the web to deflect from its normal path and to be drawn to the wall surface under sufficient pressure to be kept from fluttering. This method of web flutter control is applied to the splicing of webs, as from one roll to another in a web-fed rotary printing press. The web being unwound from the old roll has been susceptible to fluttering while being spliced to the new roll, such web fluttering being eliminable by providing a wall member along the web path and producing an airstream between the web and the wall member.

4 Claims, 5 Drawing Sheets

METHOD AND APPARATUS FOR WEB FLUTTER CONTAINMENT, AND APPLICATION TO WEB SPLICING

BACKGROUND OF THE INVENTION

This invention concerns how to suppress the fluttering of a web of paper or like continuous sheet of any comparable material traveling along a predefined path in a predetermined direction. More specifically, the invention relates to a method of, and apparatus for, web flutter control that take advantage of the Coanda effect, the familiar fluid dynamic phenomenon known also as wall attachment.

The present invention is believed to be of immense utility when applied to web flutter control during the splicing of webs in a web-fed rotary printing press because the web being printed is especially susceptible to fluttering while being spliced to a new web roll according to the customary practice in the printing industry. It is not desired, however, that the invention be limited to this particular application as it is no doubt adaptable for a variety of other applications that may involve machines dealing with traveling webs or like continuous sheets of any relatively pliant material in general.

Several practicable suggestions have been made in the art of controlling the fluttering of traveling webs. According to one such known suggestion, Japanese Patent No. 2,552,595, a pair of confronting, parallel walls are provided on opposite sides of a web path. Optionally, ports are formed in the walls for introducing air jets into the space therebetween, the air jets being directed perpendicular to the traveling web, although these jets are said to be ancillary in nature.

This first known method of web flutter containment relies on the airstreams created by the traveling web itself. As ambient air is entrained and drawn into the spaces between the web and the opposed wall surfaces, the air pressures will build up and balance each other on both sides of the web, keeping the same from fluttering which might otherwise occur even with the slightest fluctuations in web tension. The fluid pressures on both sides of the web will further increase with the introduction of jets from the wall ports, even more positively damping web oscillation. Thus, with or without use of the ancillary air jets, the web is purely fluid-dynamically prevented from fluttering, without contacting any stationary or mobile parts.

Offsetting this strength of the first prior art method are the difficulties arising from the need for provision of walls on both sides of the web path. The walls require means for supporting them, and the resulting apparatus becomes all the more bulky when means are provided for introduction of air jets through both walls into the space therebetween. The necessity of the walls on both sides of the web path manifests itself as a critical drawback when the apparatus is to be utilized for web flutter suppression during web splicing. At the supply roll station of a web-fed rotary printing press, for example, the space for wall installation is available only on one side of the web during splicing, the other side being occupied by a new roll against which the web now being printed is to be pressed for splicing. This prior art apparatus is therefore unapplicable to this end.

Japanese Unexamined Utility Model Publication No. 58-83346 teaches the use of a hollow structure for conveying ultrathin sheet material therethrough. At the upstream end of this hollow structure there are provided nozzles for creating two airstreams in the upper and lower parts of its interior, the upper stream being higher in velocity than the lower. Ultrathin sheet material is pneumatically transported down the hollow structure, always floating by virtue of the pressure differential caused by the difference between the speeds of the airflows on its upper and lower sides.

This prior art pneumatic transportation system is well calculated to keep ultrathin sheet material straight as it travels through the hollow structure. No consideration is, however, made as to how to keep the material from fluttering. For this reason alone the system is unfit for flutter control of traveling webs, not to mention the fact that its mechanical construction inhibits its use for that purpose during web splicing for the same reasons as have been set forth in connection with the first described prior art.

Japanese Utility Model No. 2,503,149 is explicitly designed to damp web fluttering during web splicing. Employed to this end are baffle plates for damping fluttering of the web which travels close to the new web roll to which that old web is to be spliced. Strategically positioned along the path of the old web, and on its side opposite to that where the new web roll lies, the baffles are intended to keep the old web from fluttering caused by the airflow induced along the surface of the new web roll as the later is driven at the same peripheral speed as the traveling speed of the old web.

An objection to this third prior art device is that the traveling old web tends to be drawn to the new web roll because of the high velocity airstream created by its rotation, the baffles being positioned only on the other side of the traveling web. Not only drawn, but the old web has actually come into contact with the new web roll, sticking, in the worst case, to the adhesive edge of the new web and thereby itself tearing or breaking. If not completely stuck to the adhesive edge of the new web, the old web has often lessened its adhesiveness as a result of forced contact or rubbing, possibly resulting in splicing failure or improper splicing.

As an additional disadvantage, the web must run in sliding contact with the baffles. The web has frequently had its surface marred, making it impossible to print correctly thereon and deteriorating the quality of the printing.

SUMMARY OF THE INVENTION

The present invention has it as an object to positively contain the fluttering of a traveling web of paper or like continuous sheet of relatively pliant material with a minimum of equipment, made possible by taking advantage of the Coanda effect.

Another object of the invention is to provide a noncontact method of web flutter containment, such that the web is not to be impaired in any way.

A further object of the invention is to provide a web flutter damping device that can be readily, compactly incorporated in a web splicing apparatus of conventional design without interference, both structurally and operationally, with the preexisting parts of the apparatus as well as with the webs to be spliced, thereby assuring more successful, trouble-free splicings than heretofore.

Briefly stated in one aspect thereof, the present invention concerns a method of damping the flutter of a traveling web of paper or the like, which comprises the steps of providing a wall on one side of a web traveling along a predefined path in a predetermined direction, and causing a gas stream to flow close to the wall surface and in the predetermined traveling direction of the web. Consequently, the traveling web is drawn toward the wall surface by virtue of a pressure reduction in the gas stream and thus kept from fluttering.

The above summarized method of web flutter suppression is easy of implementation. Thus, stated in another aspect thereof, the invention also provides an apparatus comprising, simply, a wall member having a surface disposed opposite one side of a web traveling along a predefined path in a predetermined direction, and means for producing a gas stream between the wall member and the traveling web and in the predetermined traveling direction of the web. The surface of the wall member is so contoured and arranged with respect to the gas stream producing means that the gas stream is caused to flow close to the wall surface. This phenomenon is called as the Coanda effect.

Although drawn toward the wall, the web does not come into contact therewith because of the presence of the constant gas stream between web and wall, so that the web is not subject to damage whatsoever. Another pronounced advantage is that the Coanda effect requires a wall only on one side of the web path, to which wall the web is constantly drawn rather then forced away. These features of the invention, noncontact web travel and a unilateral wall to which the web is drawn fluid-dynamically, make it admirably suitable for use with the familiar web splicing apparatus of a web-fed rotary printing press.

Therefore, in still another aspect thereof, the invention pertains to an apparatus for splicing a first web being unwound from a first roll and traveling along a predefined path in a predetermined direction, to a second web to be unwound from a second roll. The splicing apparatus includes means for pressing the first web, in a first preselected position on the predefined path, against the second roll, and means for cutting off the first web from the first roll in a second preselected position upstream of the first preselected position with respect to the predetermined traveling direction of the first web. For damping the flutter of the first web as it travels past the second roll, there is provided according to the invention a wall member which is disposed in a third preselected position downstream of the first preselected position with respect to the predetermined traveling direction of the first web. The wall member has a surface opposite one side of the first web traveling along the predefined path, another side of the first web being disposed opposite the second roll. A gas stream is created according to the invention between the wall member and the traveling first web and in the predetermined traveling direction of the first web.

In order to be spliced to the old web (referred to as the first web in the foregoing summary) now being printed, the new web roll (second roll) must be rotated at a peripheral speed matching the running speed of the old web. Traveling past this new web roll, the old web has conventionally been drawn toward that roll, usually with fluttering, because of the airflow caused peculiarly by that roll, as will be detailed later. According to the instant invention, the traveling old web is drawn toward the wall member, that is, away from the new web roll, by the pressure reduction of the gas stream and thus prevented from fluttering according to the invention.

It will be appreciated that the unilateral wall member does not interfere in any way with the new web roll, these being on opposite sides of the traveling old web. Moreover, drawn toward the wall member without contacting it, the old web is kept out of contact with the new web roll until mechanically pressed against the same for splicing. All the difficulties and inconveniences heretofore encountered in web splicing for a change from one printing roll to another are thus thoroughly overcome.

The above and other objects, features and advantages of this invention and the manner of achieving them will become more apparent, and the invention itself will best be understood, from a study of the following description and attached claims, with reference had to the accompanying drawings showing some preferable embodiments of the invention.

DETAILED DESCRIPTION OF THE INVENTION

The present invention relies on the Coanda effect for web flutter control. The Coanda effect is such that a supply jet emerging into a space bounded on one side by a wall tends to attach to the wall. Hence the more popular name "wall attachment". More specifically, the emerging jet entrains ambient fluid because of high shear on the open side of the jet. The entrained fluid is not easily replaced by ambient fluid on the wall side of the jet so that a transverse static pressure gradient is formed across the jet and forces it to flow close to the wall. For more information on the Coanda effect, reference may be had to the entry "Fluidics" in McGraw-Hill Encyclopedia of Science and Technology.

Suppose that a web of paper travels parallel to the angled wall surface at an appropriate spacing therefrom and in the same direction with the fluid flow. The Bernoulli effect states that the pressure of a stream of fluid is reduced as its speed of flow is increased. The instant invention takes advantage of this pressure reduction of the fluid flow in order to cause the web to be drawn toward the wall under sufficient pressure to be kept from fluttering.

Figure 1:
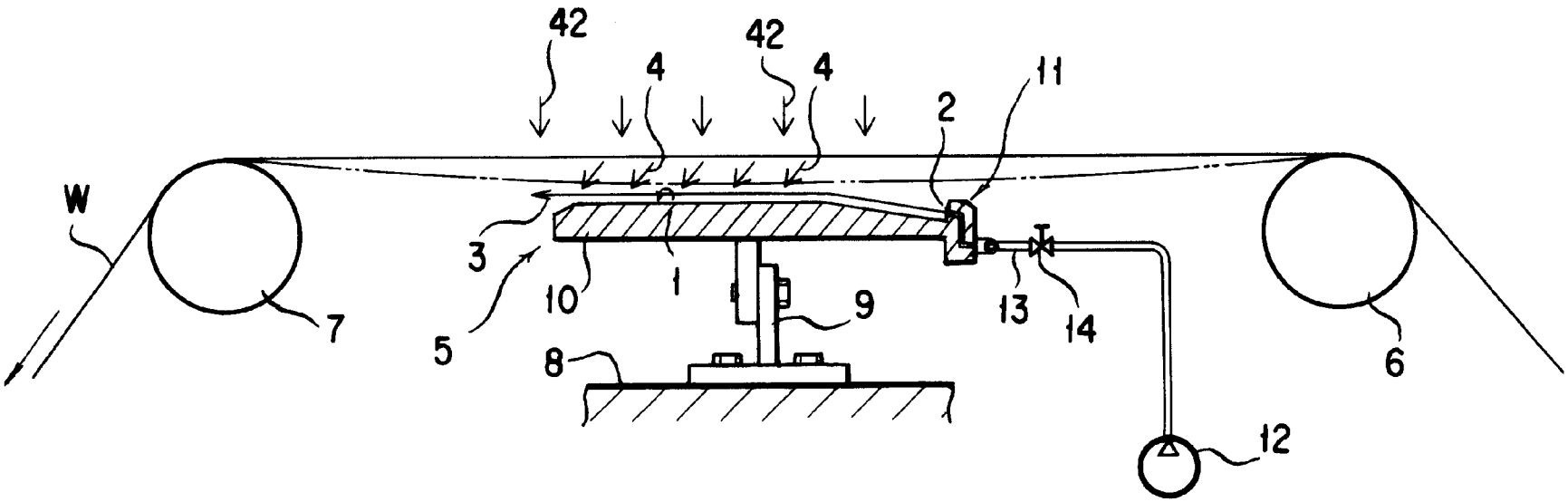
FIG. 1 is a diagrammatic illustration, partly in section, partly in elevation and partly in symbols, of an apparatus for damping the flutter of a traveling web.
Figure 2:
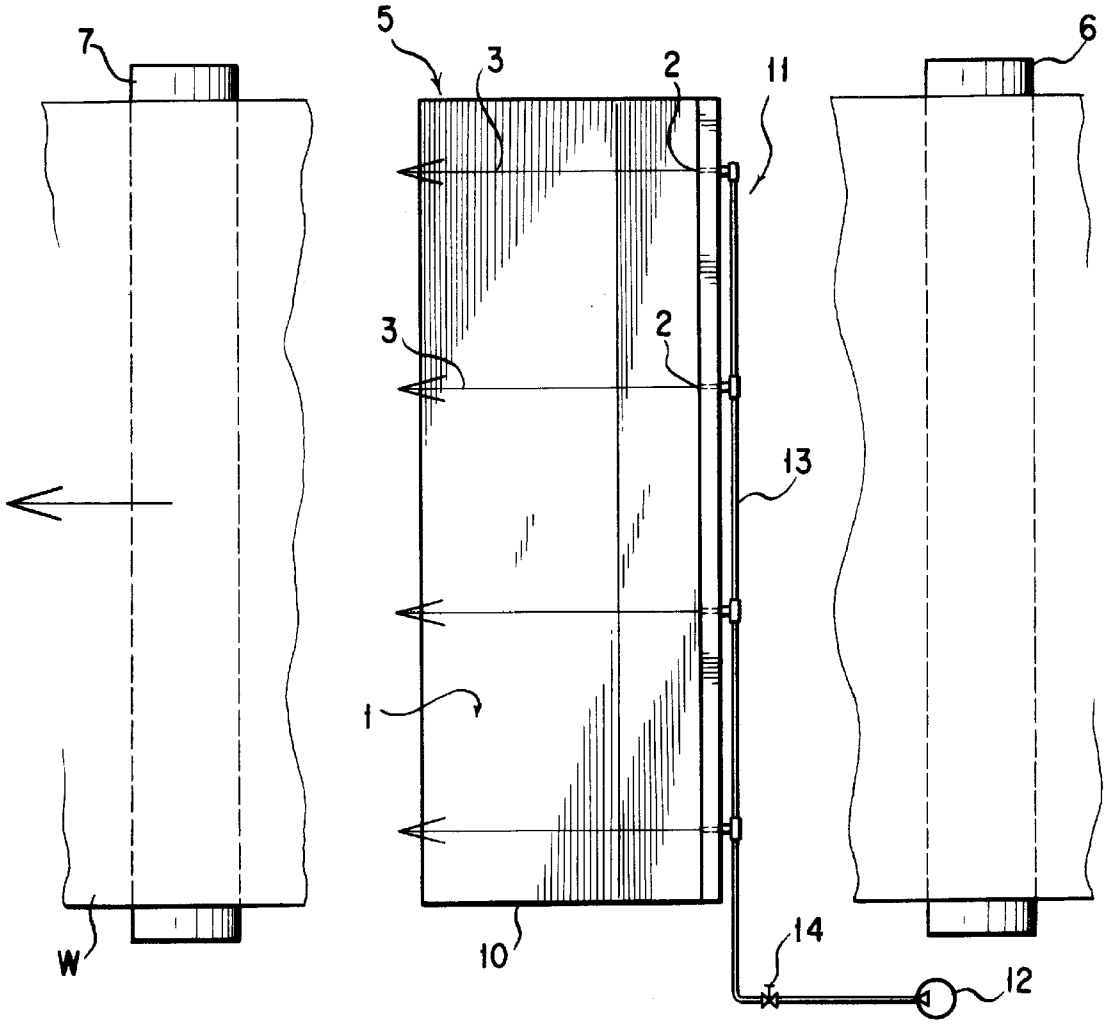
FIG. 2 is a top plan of the FIG. 1 apparatus, in which the web is shown broken away to reveal other parts.

FIGS. 1 and 2 are explanatory of the fundamental web flutter control method and apparatus according to this invention. The web W is shown traveling horizontally in the arrow-marked direction along a predefined path between two guide rollers 6 and 7. A web flutter control device 5 is shown disposed under the web W at or adjacent the position where the web flutter is to be contained, although the device could be provided on either side of the web. The web flutter control device 5 includes a wall member 10 having a contoured surface 1, and means 11 for producing streams of fluid, normally air, between the web and the wall member.

The wall member 10 is shown mounted on a suitable support structure 8 via legs 9 and has its contoured surface 1 held opposite one side of the web W, with a prescribed spacing between the normal path of the web, indicated by the solid line in FIG. 1, and the wall surface. FIG. 2 indicates that the wall member 10 extends transversely of the web W throughout its width. The dimension of the wall member 10 in the longitudinal direction of the web W depends upon each specific application.

For production of airstreams between web W and wall member 10 there are formed a plurality of, four in the illustrated embodiment, air supply ports 2 formed in a raised rim at the upstream end of the wall member and communicating with a source 12 of air under pressure by way of a conduit system 13. Arranged at constant spacings transversely of the web W, the supply ports 2 provide airstreams 3 oriented approximately in the traveling direction of the web W. Alternatively, instead of such independent supply ports or nozzles, there may be employed a single slotlike port extending transversely of the web W in order to produce a single, uniformly thick airflow over the wall member 10.

Preferably, and as indicated at 14, a flow control valve may be provided on the conduit system 13. This valve may be manipulated as required to control the flow rate of the air emerging from the supply ports 2, hence the pressure between the web W and the wall member 10, and hence the degree to which the web is drawn toward the wall member.

It will be observed from both FIGS. 1 and 2 that the wall surface 1 includes an upstream portion of relatively short extent which is angled toward the path of the web W as it extends in the traveling direction of the web, and a downstream portion of greater extent which extends parallel to the normal web path. The downstream portion is shown to be horizontal, and the upstream portion at an angle to the plane of the horizon, in the illustrated embodiment.

Emerging from the supply ports 2, the airstreams will first travel along the angled upstream portion of the wall surface 1 and then, flowing at an angle onto the horizontal downstream surface portion, bend itself and attach to this latter surface portion by the Coanda effect. The low-pressure airstreams 3 along the horizontal wall surface portion will entrain the ambient air, as indicated by the arrows designated 4 in FIG. 1, causing the static pressure 42 to be exerted downwardly on the web W. This web will then be urged toward the wall member 10, as indicated by the dot-and-dash line in FIG. 1. Thus, traveling in pneumatic confinement between the airstreams 3 on the horizontal wall surface portion and the static pressure 42 from above, the web W will be prevented from fluttering as it traverses the wall member.

As required, the web may be caused to travel even closer to the wall surface. The airstreams 3 will then attach both to the surface of the wall member 1 and to one side of the web W, creating a partial vacuum in practically all the space therebetween and thus even more positively retraining the web from fluttering.

Figure 3:
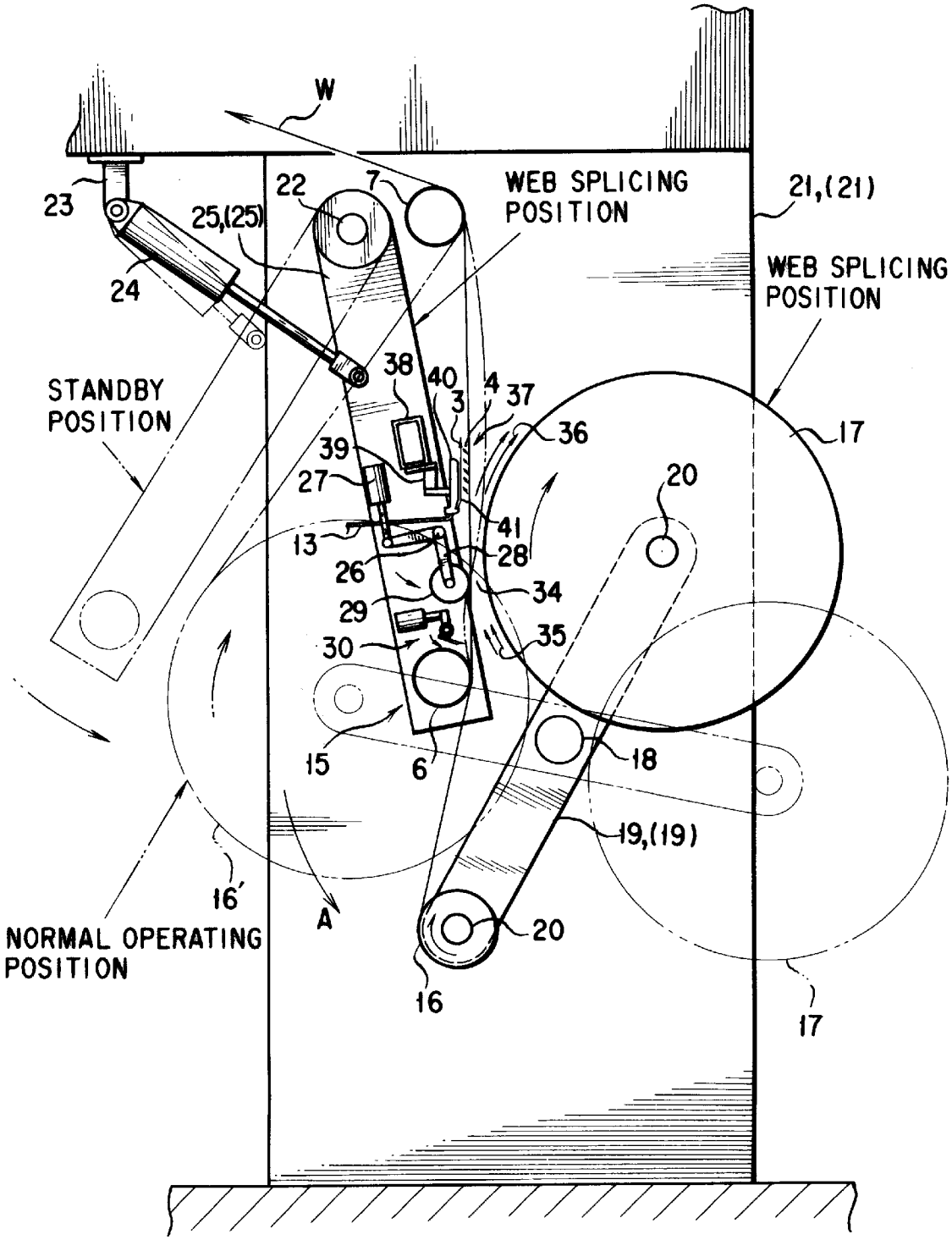
FIG. 3 is an elevation of a supply roll section of a web-fed rotary printing press, the view showing the FIG. 1 apparatus as adapted for web flutter containment during web splicing from one supply roll to another in the press.
Figure 4:
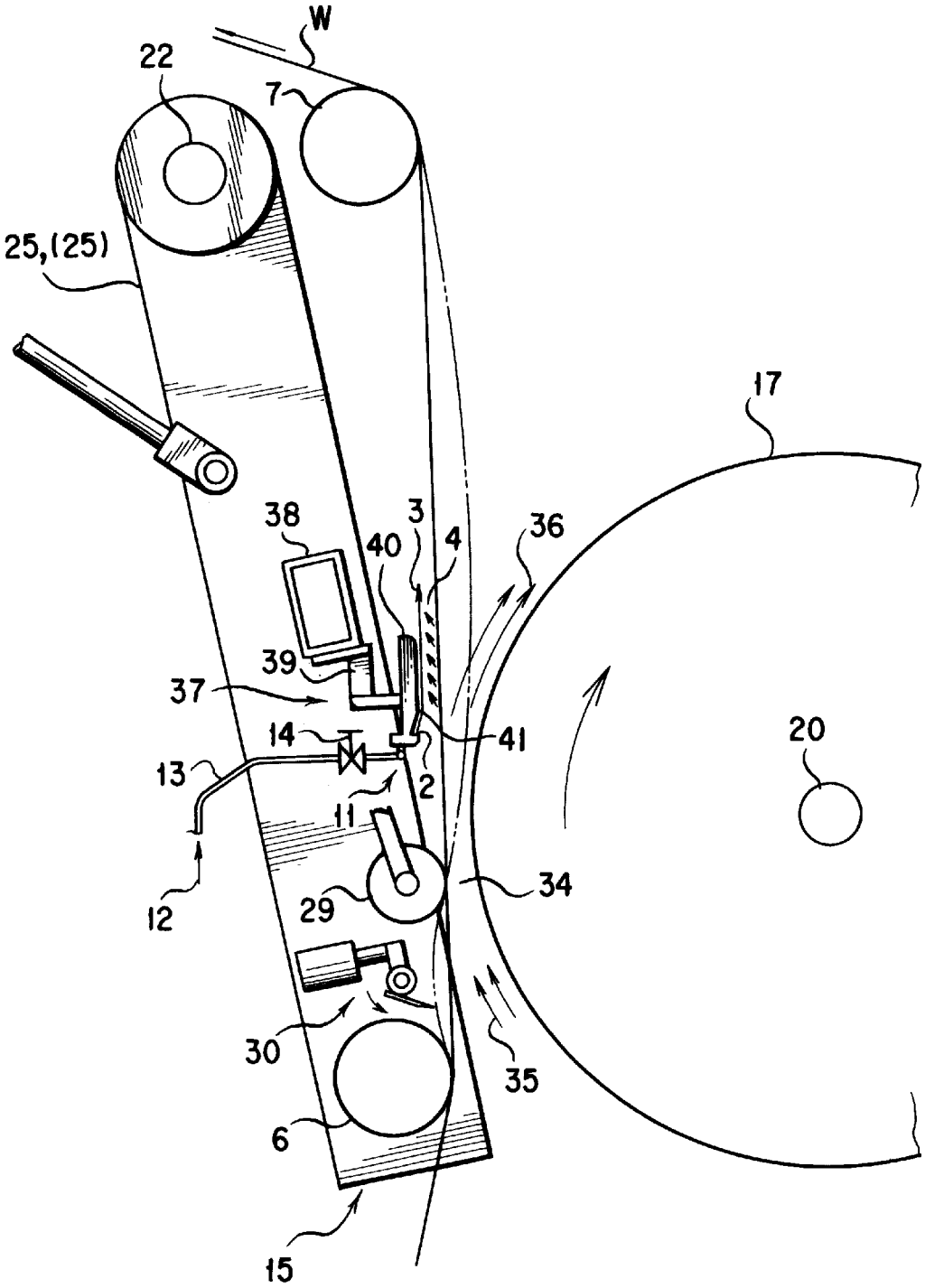
FIG. 4 is an enlarged representation of part of the showing of FIG. 3.

FIGS. 3 and 4 show the principles of this invention applied to web flutter suppression during the splicing of webs for a change from one paper roll to another in a web-fed rotary printing press. At 19 in FIG. 3 are seen a pair of spider arms 19, one seen, each medially pivoted by a medial pivot 18 and conjointly rotatably carrying an old roll 16 and a new roll 17 on their opposite ends via spindles 20.

Normally, that is, until the old roll 16 is consumed to a prescribed diameter, the pair of spider arms 19 are in the normal operating position indicated by the phantom outline in FIG. 3, holding the old roll 16 and new roll 17 in the positions also indicated by the phantom outlines. Unwound from the old roll 16 in this normal operating position, the web W is threaded over a guide roller 7 and directed toward the printing section, not shown, of the press. When this web is nearly used up, decreasing the old roll 16 to the prescribed diameter, the spider arms 19 are turned counterclockwise, as viewed in FIG. 3, about their medial pivot 18 from their normal operating to splicing position, the latter position being indicated by the solid lines in the same figure. In this splicing position the web W from the old roll 16 is spliced to the new roll 17 on its way to the guide roller 7.

Employed for such web splicing is a splicer mechanism 15 comprising a pair of splicer carrier arms 25 each supported at one end by a pivot 22 on one of a pair of confronting framing walls 21 erected at the supply roll section of the press. The splicer carrier arms 25 are jointly pivoted by a fluid actuated cylinder 24 between the phantom standby position and the solidline splicing position. The cylinder 24 is bracketed at 23 to the frame.

As pictured on a somewhat enlarged scale in FIG. 4, the splicer carrier arms 25 carry, first of all, a guide roller 6 which rotatably extends between their free ends. Disposed upstream of the other, nondisplaceable guide roller 7 on the framing walls 21, the guide roller 6 coacts therewith to determine part of the path for the web W from the old roll 16 toward the printing section of the press when the splicer carrier arms 25 are in the splicing position.

Downstream of the guide roller 6, a bristled pressure roller 29 has its opposite ends rotatably supported by a pair of swing arms 28, FIG. 3, which are pivoted on a shaft 26 extending between, and rotatably supported by, the splicer carrier arms 25. The swing arms 28 are jointly swung back and forth by a fluid actuated cylinder 27 operatively mounted to one of the splicer carrier arms 25. Thus, with the extension of this cylinder 27 when the splicer carrier arms 25 are in the splicing position, the pressure roller 29 pushes the old web W, on its way from guide roller 6 to guide roller 7, against the new roll 17 for splicing.

Figure 5:
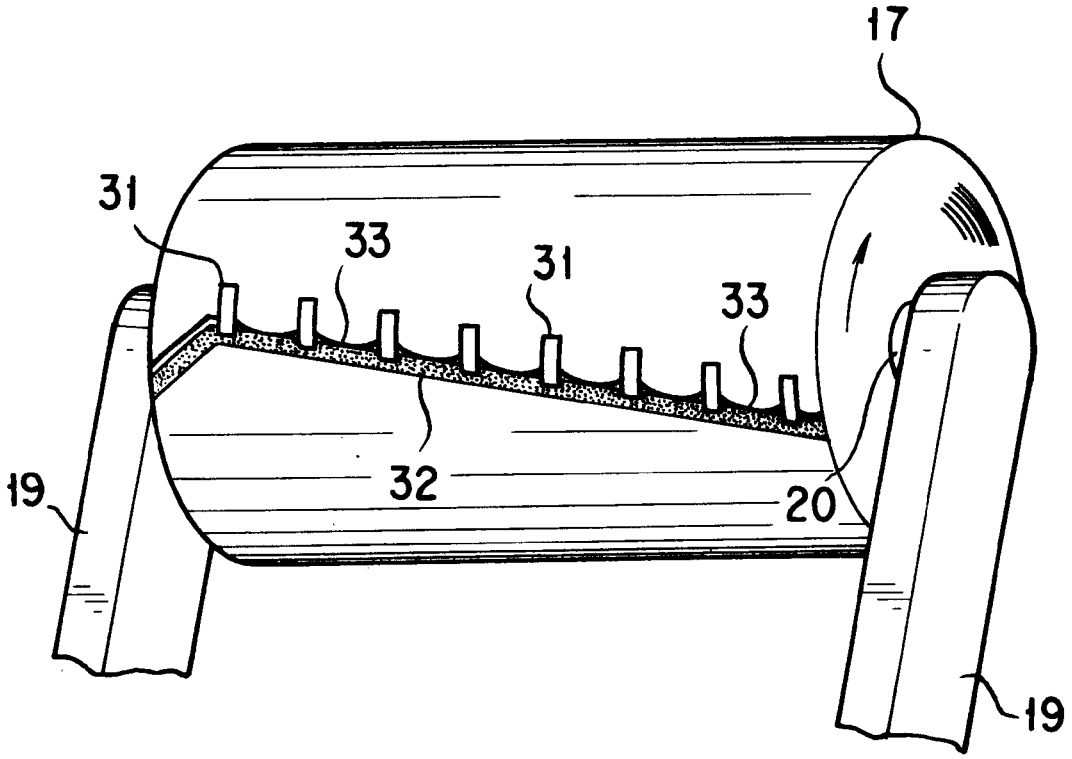
FIG. 5 is a perspective view of a new roll to which the web being printed in the FIG. 3 press is to be spliced, showing in particular how the outer end of the rolled web is prepared for splicing.

As illustrated in perspective in FIG. 5, the new roll 17 has its outer extremity conventionally affixed to the roll surface by several spaced pieces 31 of adhesive tape. Along the preformed edge of the outer roll extremity there is formed an adhesive region 32 against which the old web is to be pressed as aforesaid by the pressure roller 29. The adhesive pieces 31 are strong enough to hold the roll edge against the roll surface when this new roll is driven at approximately the same peripheral speed as the traveling speed of the old web W but must readily tear when the old web is pressed as above stated against the adhesive region 32 of the new roll, permitting the new web to be unwound therefrom by being adherently joined to the old web.

With reference back to FIGS. 3 and 4 the splicer mechanism 15 further comprises cutoff means 30 mounted to the pair of splicer carrier arms 25 for cutting off the old web from the old roll 16 after the old web has been joined as above to the new web on the roll 17. The cutoff means 30 lies just upstream of the pressure roller 29.

The splicer mechanism 15 additionally incorporates means 37 for damping the fluttering of the old web W which is particularly liable to occur when the spider arms 19 are in the splicing position and before and during the splicing of the old web to the new. The web flutter damping means 37 is largely of the FIG. 1 construction, comprising a wall member 40 extending between the pair of splicer carrier arms 25 in a position downstream of the pressure roller 29, and means 11 for producing airstreams along the contoured surface 41 of the wall member. Bracketed by a plurality of brackets 39 to a cross member 38 which is secured to and extends between the splicer carrier arms 25, the wall member 40 has its surface 41 held opposite one side of the old web W when the spider arms 19 and the splicer carrier arms 25 are both in their splicing positions. The airstream means 11 includes the conduit system 13 communicating the source 12, FIGS. 1 and 2, of air under pressure with the supply ports 2 at the upstream end of the wall member 40. The flow control valve 14 is provided on the conduit system 13.

In operation the pair of spider arms 19 will be turned in the direction of the arrow A, FIG. 3, about their medial pivot 18 from their phantom normal operating position to solidline splicing position when the old roll 16 is consumed to the prescribed diameter. It will be noted from both FIGS. 3 and 4 that the new roll 17 is now brought very much closer to the old web W running from the old roller 16 to the nondisplaceable guide roller 7.

Approximately concurrently with the above described movement of the spider arms 19 to the splicing position, the pair of splicer carrier arms 25 will also be turned to the splicing position by the extension of the cylinder 24. The displaceable guide roller 6 on these splicer carrier arms is now in engagement with the old web W, causing the latter to travel approximately perpendicularly up to the nondisplaceable guide roller 7.

Prepared for splicing as shown in FIG. 5, the new roll 17 is revolved at the same peripheral speed as the running speed of the old web. This rotation of the new roll will almost inevitably result in the entrapping of the air in the pockets 33, FIG. 5, of the new roll 17, such pockets being created by those parts of the outer web edge which are not attached to the roll surface by the pieces 31 of adhesive tape. These web pockets will give rise to airflow 35, FIG. 4, with the rotation of the new roll. The airflow will act on the old web just upstream of the region 34 of minimum spacing between old web and new web roll, forcing the old web into arcuate shape between guide roller 6 and pressure roller 29, as indicated by the broken line in FIG. 4.

Then, emerging from the minimum spacing region 34, the airflow 36 will become higher in velocity and, in consequence, lower in pressure than on its upstream side. Consequently, were it not for the web flutter damping means 37 according to this invention, the old web would be drawn toward the new roll 17 on the downstream side of the pressure roller 29, as drawn also by the broken line in FIG. 4. This warping of the old web, caused by the pressure differential across the minimum spacing region 34, would almost certainly involve web fluttering due to fluctuations in web tension or the rotation of the new roll 17 with its pockets 33.

In order to defeat such web warping and fluttering, with the accompanying inconveniences set forth previously, airstreams 3 are produced from the ports 2 in the wall member 40 so as to cause the airstreams to travel close to the wall surface 41. The resulting pressure reduction along the wall surface will suffice to hold the old web W on its normal path, preventing the web from deflecting toward the new roll 17.

As required, the flow control valve 14 may be manipulated to maintain the pressure lower on the wall side of the old web than on its new roll side. The wall side pressure may be made so low, indeed, that the old web will be drawn away from its normal path toward the wall surface and thus positively restrained from fluttering.

The pressure roller 29 may now be actuated to press the traveling old web W against the revolving new roll 17. The pieces 31 of adhesive tape on the new roll 17 will all readily tear or come off upon adhesion of the old web to the adhesive region 32 of the new web, permitting the same to be unwound from the new roll. Splicing is completed as an extra length of the old web is cut off by the cutoff means 30 in a position just upstream of the pressure roll 29.

It will be appreciated that, restrained from fluttering and stably traveling along the predefined path between the guide rollers 6 and 7, the old web W is not to contact the new web until forced into contact therewith by the pressure roller 29. Web tearings or other splicing failures are practically eliminated, and more successful splicings than heretofore are assured particularly when the web is running at high speed. Furthermore, the running web is not to contact the wall surface, either, because of the presence of airflow therebetween. Both surfaces of the web are therefore not to be impaired, contributing to the production of the highest quality printings.

Although the present invention has been described very specifically and as adapted for web splicing in a web-fed printing press, it is envisaged within the scope of this invention to apply the teachings hereof to other purposes. Further a variety of modifications and alterations of the illustrated embodiment may be made in order to conform to design preferences or to the requirements of each specific application, without departing from the proper scope or fair meaning of the claims which follow.

What is claimed is:

1. In an apparatus for splicing a first web being unwound from a first roll and traveling along a predefined path in a predetermined direction, to a second web to be unwound from a second roll, including means for pressing the first web, in a first preselected position on the predefined path, against the second roll, and means for cutting off the first web from the first roll in a second preselected position upstream of the first preselected position with respect to the predetermined traveling direction of the first web, a device for damping the flutter of the first web comprising:

(a) a wall member to be disposed in a third preselected position downstream of the first preselected position with respect to the predetermined traveling direction of the first web, the wall member having a surface to be disposed opposite one side of the first web traveling along the predefined path, another side of the first web being disposed opposite the second roll; and (b) means for producing a gas stream between the wall member and the one side of the traveling first web and in the predetermined traveling direction of the first web, the surface of the wall member being so contoured and arranged with respect to the gas stream producing means that the gas stream is caused to flow close to the wall surface by the Coanda effect;

(c) wherein the traveling first web is drawn toward the wall surface by virtue of a pressure reduction in the gas stream relative to the other side of the web and thereby kept from fluttering without contacting the wall surface as the first web is pressed against the second roll for splicing.

2. The flutter damping device of claim 1 further comprising means for adjustably varying the flow rate of the gas stream for most flutter-free travel of the first web.

3. An apparatus for splicing a first web being unwound from a first roll and traveling along a predefined path in a predetermined direction, to a second web to be unwound from a second roll, the apparatus comprising:

(a) carrier means movable between a splicing position and a standby position;

(b) means on the carrier means for pressing the first web, in a first preselected position on the predefined path, against the second roll when the carrier means is in the splicing position;

(c) means on the carrier means for cutting off, when the carrier means is in the splicing position, the first web from the first roll in a second preselected position upstream of the first preselected position with respect to the predetermined traveling direction of the first web;

(d) a wall member mounted to the carrier means and having a surface disposed, when the carrier means is in the splicing position, opposite one side of the first web in a third preselected position downstream of the first preselected position with respect to the predetermined traveling direction of the first web, another side of the first web being disposed opposite the second roll; and (e) means for producing a gas stream between the wall member and the one side of the traveling first web and in the predetermined traveling direction of the first web when the carrier means is in the splicing position, the surface of the wall member being so contoured and arranged with respect to the gas stream producing means that the gas stream is caused to flow close to the wall surface;

(f) wherein the traveling first web is drawn toward the wall surface by virtue of a pressure reduction in the gas stream relative to the other side of the web and thereby kept from fluttering without contacting the wall surface as the first web is pressed against the second roll for splicing.

4. The web splicing apparatus of claim 3 further comprising means for adjustably varying the flow rate of the gas stream for most flutter-free travel of the first web.

* * * * *